US008713943B2

(12) United States Patent
Poyyapakkam et al.

(10) Patent No.: US 8,713,943 B2
(45) Date of Patent: May 6, 2014

(54) REHEAT BURNER INJECTION SYSTEM WITH FUEL LANCES

(75) Inventors: Madhavan Poyyapakkam, Rotkreuz (CH); Urs Benz, Gipf-Oberfrick (CH); Andre Theuer, Baden (CH); Anton Winkler, Olching (DE); Andrea Ciani, Zurich (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/465,544

(22) Filed: May 7, 2012

(65) Prior Publication Data

US 2012/0297777 A1 Nov. 29, 2012

Related U.S. Application Data

(63) Continuation of application No. PCT/EP2010/066497, filed on Oct. 29, 2010.

(30) Foreign Application Priority Data

Nov. 7, 2009 (CH) ..... 1887/09

(51) Int. Cl.
*F02C 1/00* (2006.01)
*F02G 3/00* (2006.01)

(52) U.S. Cl.
USPC ..... 60/737

(58) Field of Classification Search
CPC ..... F23R 3/286; F23R 3/20; F23R 3/18; F23R 2900/03341; F23R 2900/03042; F23R 3/50; F23R 3/10; F23R 3/283; F23D 17/002; F23D 14/78; F02K 3/10; Y02T 50/675; F23C 5/08
USPC ..... 60/748, 742, 740, 39.463, 761, 763, 60/765, 804, 239, 402, 403, 737; 239/402–405
See application file for complete search history.

(56) References Cited

U.S. PATENT DOCUMENTS 580,360 A 4/1897 Bachy
2,478,851 A * 8/1949 Traupel ..... 60/39.17
(Continued)

FOREIGN PATENT DOCUMENTS

EP 0 473 371 A1 3/1992
EP 0 911 585 A1 4/1999
(Continued)

OTHER PUBLICATIONS

International Search Report (PCT/ISA/210) issued on Jul. 14, 2011, by the European Patent Office as the International Searching Authority for International Application No. PCT/EP2010/066497.
(Continued)

*Primary Examiner* — Phutthiwat Wongwian
*Assistant Examiner* — William Breazeal
(74) *Attorney, Agent, or Firm* — Buchanan Ingersoll & Rooney PC

(57) ABSTRACT

The disclosure relates to a burner such as for a secondary combustion chamber of a gas turbine with sequential combustion having a first and a second combustion chamber, with an injection device for introduction of at least one gaseous and/or liquid fuel into the burner. The injection device has at least one body which is arranged in the burner with at least one nozzle for introducing the at least one gaseous fuel into the burner, the at least one body being configured as a streamlined body which has a streamlined cross-sectional profile and which extends with a longitudinal direction perpendicularly or at an inclination to a main flow direction prevailing in the burner. At least one nozzle has its outlet orifice downstream of a trailing edge of the streamlined body.

20 Claims, 5 Drawing Sheets

(56) References Cited

U.S. PATENT DOCUMENTS

| | | | | | |
|---|---|---|---|---|---|
| 2,944,388 | A | | 7/1960 | Bayer | |
| 3,373,567 | A | | 3/1968 | Palfreyman et al. | |
| 3,620,012 | A | | 11/1971 | Wilde | |
| 4,830,315 | A | | 5/1989 | Presz, Jr. et al. | |
| 4,887,425 | A | | 12/1989 | Vdoviak | |
| 4,932,861 | A | | 6/1990 | Keller et al. | |
| 5,203,796 | A | | 4/1993 | Washam et al. | |
| 5,235,813 | A | | 8/1993 | McVey et al. | |
| 5,251,447 | A | | 10/1993 | Joshi et al. | |
| 5,297,391 | A | | 3/1994 | Roche | |
| 5,315,815 | A | | 5/1994 | McVey et al. | |
| 5,351,477 | A | | 10/1994 | Joshi et al. | |
| 5,423,608 | A | | 6/1995 | Chyou et al. | |
| 5,431,018 | A | | 7/1995 | Keller et al. | |
| 5,433,596 | A | | 7/1995 | Dobbeling et al. | |
| 5,487,659 | A | | 1/1996 | Eroglu et al. | |
| 5,511,375 | A | | 4/1996 | Joshi et al. | |
| 5,513,982 | A | | 5/1996 | Althaus et al. | |
| 5,593,302 | A | | 1/1997 | Althaus et al. | |
| 5,622,054 | A | | 4/1997 | Tingle | |
| 5,626,017 | A | | 5/1997 | Sattelmayer | |
| 5,638,682 | A | | 6/1997 | Joshi et al. | |
| 5,647,200 | A | | 7/1997 | Althaus | |
| 5,685,140 | A | * | 11/1997 | Clements et al. | 60/204 |
| 5,735,126 | A | * | 4/1998 | Schulte-Werning | 60/732 |
| 5,794,449 | A | | 8/1998 | Razdan et al. | |
| 5,803,602 | A | | 9/1998 | Eroglu et al. | |
| 5,813,232 | A | | 9/1998 | Razdan et al. | |
| 5,865,024 | A | | 2/1999 | Kress et al. | |
| 5,941,064 | A | | 8/1999 | Chevalier et al. | |
| 6,082,111 | A | | 7/2000 | Stokes | |
| 6,112,516 | A | | 9/2000 | Beule et al. | |
| 6,263,660 | B1 | | 7/2001 | Lawlor | |
| 6,460,326 | B2 | | 10/2002 | Bechtel et al. | |
| 6,786,430 | B2 | | 9/2004 | Hayashi | |
| 6,795,192 | B2 | | 9/2004 | Dickopf et al. | |
| 8,047,001 | B2 | | 11/2011 | Beeck et al. | |
| 2002/0038542 | A1 | | 4/2002 | Akama et al. | |
| 2002/0187448 | A1 | | 12/2002 | Eroglu et al. | |
| 2003/0128364 | A1 | | 7/2003 | Dickopf et al. | |
| 2006/0016192 | A1 | | 1/2006 | Bunel et al. | |
| 2006/0230764 | A1 | | 10/2006 | Schmotolocha et al. | |
| 2007/0033945 | A1 | | 2/2007 | Goldmeer et al. | |
| 2007/0151250 | A1 | | 7/2007 | Haynes | |
| 2008/0078182 | A1 | | 4/2008 | Evulet | |
| 2009/0081048 | A1 | | 3/2009 | Beeck et al. | |
| 2010/0300109 | A1 | | 12/2010 | Carroni et al. | |

FOREIGN PATENT DOCUMENTS

| | | | | | |
|---|---|---|---|---|---|
| EP | 1 434 007 | A2 | | 6/2004 | |
| EP | 1 619 441 | A1 | | 1/2006 | |
| EP | 1 752 709 | A2 | | 2/2007 | |
| EP | 1 257 809 | B1 | | 10/2007 | |
| EP | 1 847 696 | A1 | | 10/2007 | |
| EP | 2 072 899 | A1 | | 6/2009 | |
| EP | WO2009080600 | | * | 7/2009 | F23R 3/28 |
| GB | 2 216 999 | A1 | | 10/1989 | |
| GB | 2 293 001 | A | | 3/1996 | |
| JP | 54-121425 | A | | 9/1979 | |
| WO | WO 00/19081 | A2 | | 4/2000 | |
| WO | WO 2009/019113 | A2 | * | 2/2009 | F23R 3/28 |

OTHER PUBLICATIONS

Written Opinion (PCT/ISA/237) issued on Jul. 14, 2011, by the European Patent Office as the International Searching Authority for International Application No. PCT/EP2010/066497.

Swiss Search Report issued on May 12, 2010 for Swiss Application No. 1887/2009.

International Search Report (PCT/ISA/210) issued on Jun. 4, 2011, by the European Patent Office as the International Searching Authority for International Application No. PCT/EP2010/066513.

Written Opinion (PCT/ISA/237) issued on Jun. 4, 2011, by the European Patent Office as the International Searching Authority for International Application No. PCT/ EP2010/066513.

Swiss Search Report issued on May 12, 2010 for Swiss Application No. 1888/2009.

International Search Report (PCT/ISA/210) issued on Jul. 14, 2011, by the European Patent Office as the International Searching Authority for International Application No. PCT/EP2010/066395.

Written Opinion (PCT/ISA/237) issued on Jul. 14, 2011, by the European Patent Office as the International Searching Authority for International Application No. PCT/ EP2010/066395.

Swiss Search Report issued on May 12, 2010 for Swiss Application No. 1886/2009.

International Search Report (PCT/ISA/210) issued on Jan. 20, 2011, by the European Patent Office as the International Searching Authority for International Application No. PCT/EP2010/066522.

Written Opinion (PCT/ISA/237) issued on Jul. 14, 2011, by the European Patent Office as the International Searching Authority for International Application No. PCT/EP2010/066522.

Swiss Search Report issued on Apr. 7, 2010 for Swiss Application No. 1889/2009.

International Search Report (PCT/ISA/210) issued on Jan. 20, 2011, by the European Patent Office as the International Searching Authority for International Application No. PCT/EP2010/066535.

Written Opinion (PCT/ISA/237) issued on Jan. 20, 2011, by the European Patent Office as the International Searching Authority for International Application No. PCT/ EP2010/066535.

Swiss Search Report issued on Apr. 6, 2010 for Swiss Application No. 1890/2009.

Office Action dated Jun. 21, 2013 issued by the USPTO in corresponding U.S. Appl. No. 13/465,752.

Flack, "Fundamentals of Jet Propulsion with Applications", Cambridge Aerospace Series, Cambridge Press, 2005, p. 19.

Cumpsty, "Jet Propulsion: A Simple Guide to the Aerodynamic and Thermodynamic Design and Performance of Jet Engines", 2003 2nd Ed. Cambridge University Press, p. 1.

Morris, "Analyses for Turbojet Thrust Augmentation with Fuel-Rich Afterburning of Hydrogen, Dibroane, and Hydrazine", National Advsiory Committee for Aeronautics, 1957, pp. 1-22.

Lundin, Summary of NACA Research on Afterburners for Turbojet Engines, 1956, pp. 1-102.

* cited by examiner

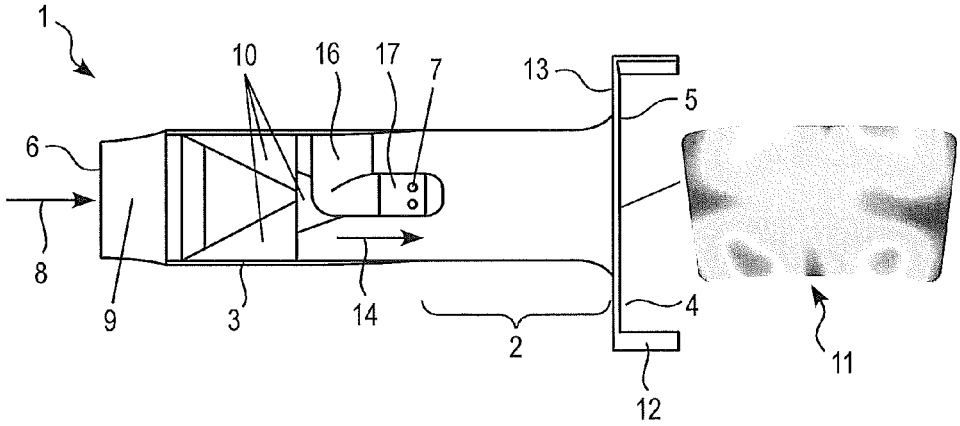
PRIOR ART
FIG. 1
FIG. 2
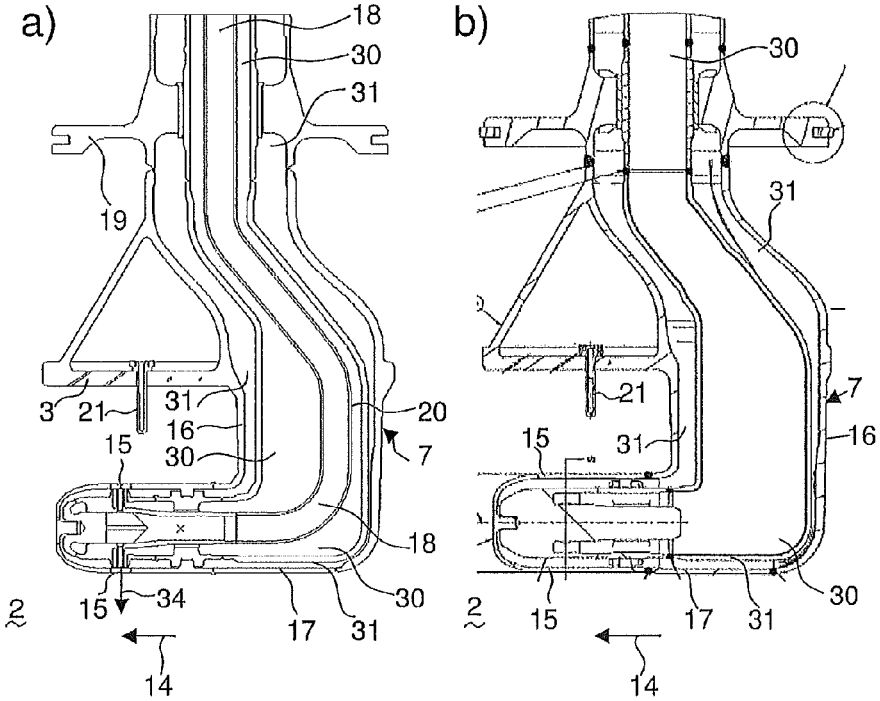

REHEAT BURNER INJECTION SYSTEM WITH FUEL LANCES

RELATED APPLICATION

This application claims priority as a continuation application under 35 U.S.C. §120 to PCT/EP2010/066497, which was filed as an International Application on Oct. 29, 2010 designating the U.S., and which claims priority to Swiss Application 01887/09 filed in Switzerland on Nov. 7, 2009. The entire contents of these applications are hereby incorporated by reference in their entireties.

FIELD

The present disclosure relates to a burner for a secondary combustion chamber of a gas turbine with sequential combustion having a first and a secondary combustion chamber, with an injection device for the introduction of at least one gaseous fuel into the burner.

BACKGROUND INFORMATION

In order to achieve improved efficiency, a high turbine inlet temperature is used in standard gas turbines. As a result, there arise high NOx emission levels and higher life cycle costs. This can be mitigated with a sequential combustion cycle, wherein the compressor delivers nearly double the pressure ratio of known compressors. The main flow passes the first combustion chamber (e.g. using a burner of the general type as disclosed in EP 1 257 809 or as in U.S. Pat. No. 4,932,861, also called EV combustor, where the EV stands for environmental), wherein a part of the fuel is combusted. After expanding at the high-pressure turbine stage, the remaining fuel is added and combusted (e.g. using a burner of the type as disclosed in U.S. Pat. No. 5,431,018 or U.S. Pat. No. 5,626,017 or in US 2002/0187448, also called SEV combustor, where the S stands for secondary). Both combustors contain premixing burners, as low NOx emissions require high mixing quality of the fuel and the oxidizer.

Since the second combustor is fed by expanded exhaust gas of the first combustor, the operating conditions allow self ignition (spontaneous ignition) of the fuel air mixture without additional energy being supplied to the mixture. To prevent ignition of the fuel air mixture in the mixing region, the residence time therein should not exceed the auto ignition delay time. This criterion can ensure flame-free zones inside the burner. This criterion can pose challenges in obtaining appropriate distribution of the fuel across the burner exit area.

SEV-burners are currently designed for operation on natural gas and oil only. Therefore, the momentum flux of the fuel is adjusted relative to the momentum flux of the main flow so as to penetrate in to the vortices. The subsequent mixing of the fuel and the oxidizer at the exit of the mixing zone is just sufficient to allow low NOx emissions (mixing quality) and avoid flashback (residence time), which may be caused by auto ignition of the fuel air mixture in the mixing zone.

SUMMARY

A burner for a combustion chamber of a turbine is disclosed, comprising: an injection device for introduction of at least one gaseous and/or liquid fuel into the burner, wherein the injection device has at least one body which is arranged in the burner with at least one nozzle at a trailing edge of the body for introducing the at least one fuel into the burner, the at least one body being configured as a streamlined body which has a streamlined cross-sectional profile and which extends with a longitudinal direction perpendicularly or at an inclination to a main flow direction prevailing in the burner; and two lateral surfaces of the body essentially parallel to the main flow direction, wherein the at least one nozzle has an outlet orifice downstream of the trailing edge of the streamlined body.

BRIEF DESCRIPTION OF THE DRAWINGS

Exemplary embodiments of the disclosure are described in the following with reference to the drawings, which are for the purpose of illustrating the present exemplary embodiments of the disclosure and not for the purpose of limiting the same. In the drawings, FIG. 1 shows a secondary burner located downstream of a high-pressure turbine together with a fuel mass fraction contour (right side) at the exit of the burner;

FIG. 2 shows axial cuts through secondary burner fuel lances, wherein in a) a dual fuel lance is given and in b) a gas only fuel lance is illustrated;

DETAILED DESCRIPTION

Figure 3:
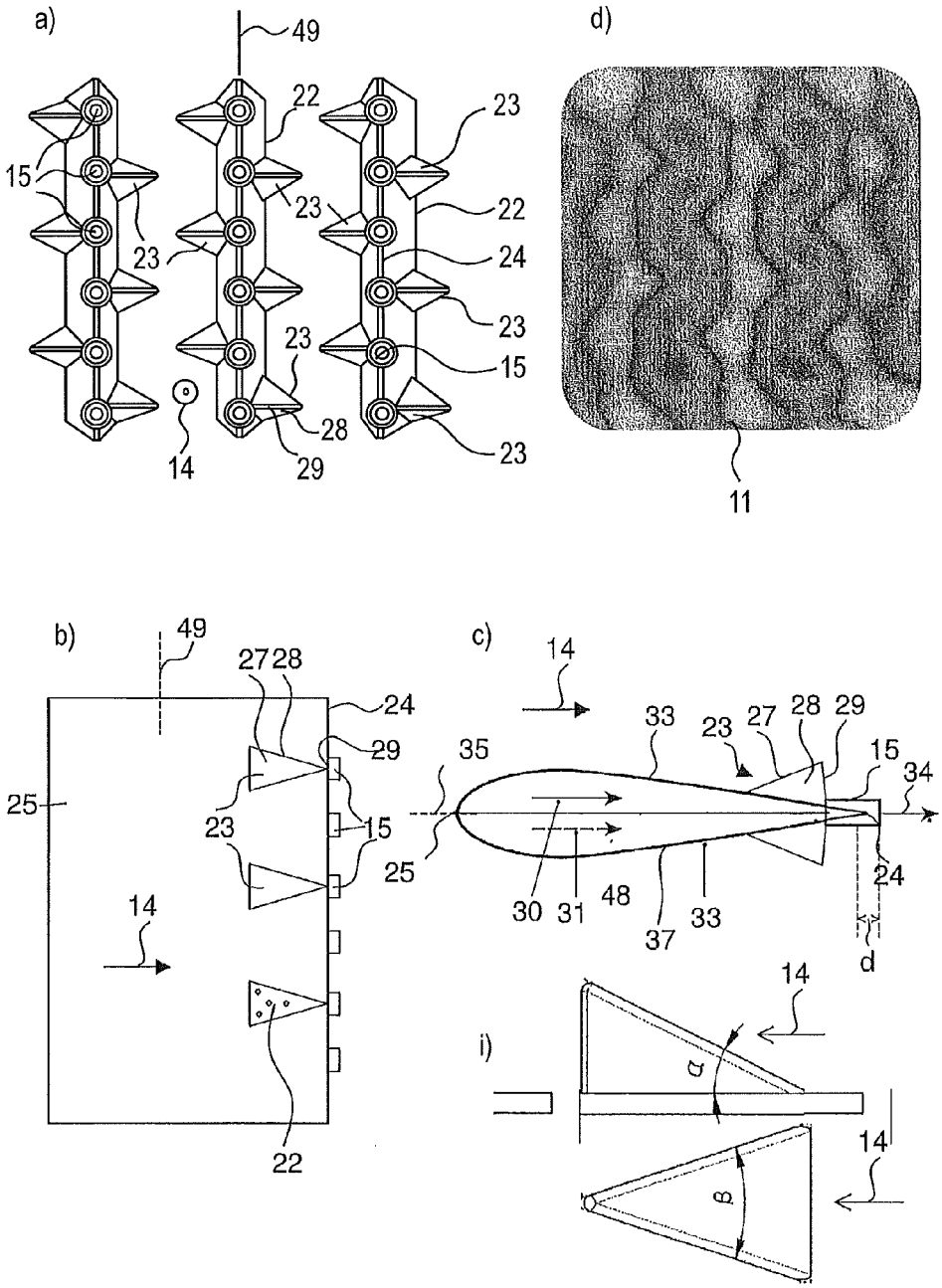
FIG. 3 shows exemplary embodiments in a) the streamlined body in a view opposite to the direction of the flow of oxidising medium with fuel injection parallel to the flow of oxidising medium, in b) a side view onto such a streamlined body, in c) a cut perpendicular to the central plane of the streamlined body, in d) the corresponding fuel mass fraction contour at the exit of the burner, in e) a perspective view showing the outer wall structure of the streamlined body as well as the inner fuel tubing, in f) a simplified lateral view onto the fuel tubing only, in g) a detailed view onto the transition between the longitudinal part of the inner fuel tubing and the branching tube, in h) a detailed view onto a different embodiments with a difference transition between the longitudinal part of the inner fuel tubing and the branching tube in i) a schematic sketch how the attack angle and a sweep angle of the vortex generator are defined, wherein in the upper representation a side elevation view is given, and in the lower representation a view onto the vortex generator in a direction perpendicular to the plane on which the vortex generator is mounted are given, and in k) a perspective view onto a body and its interior structure.
Figure 3:
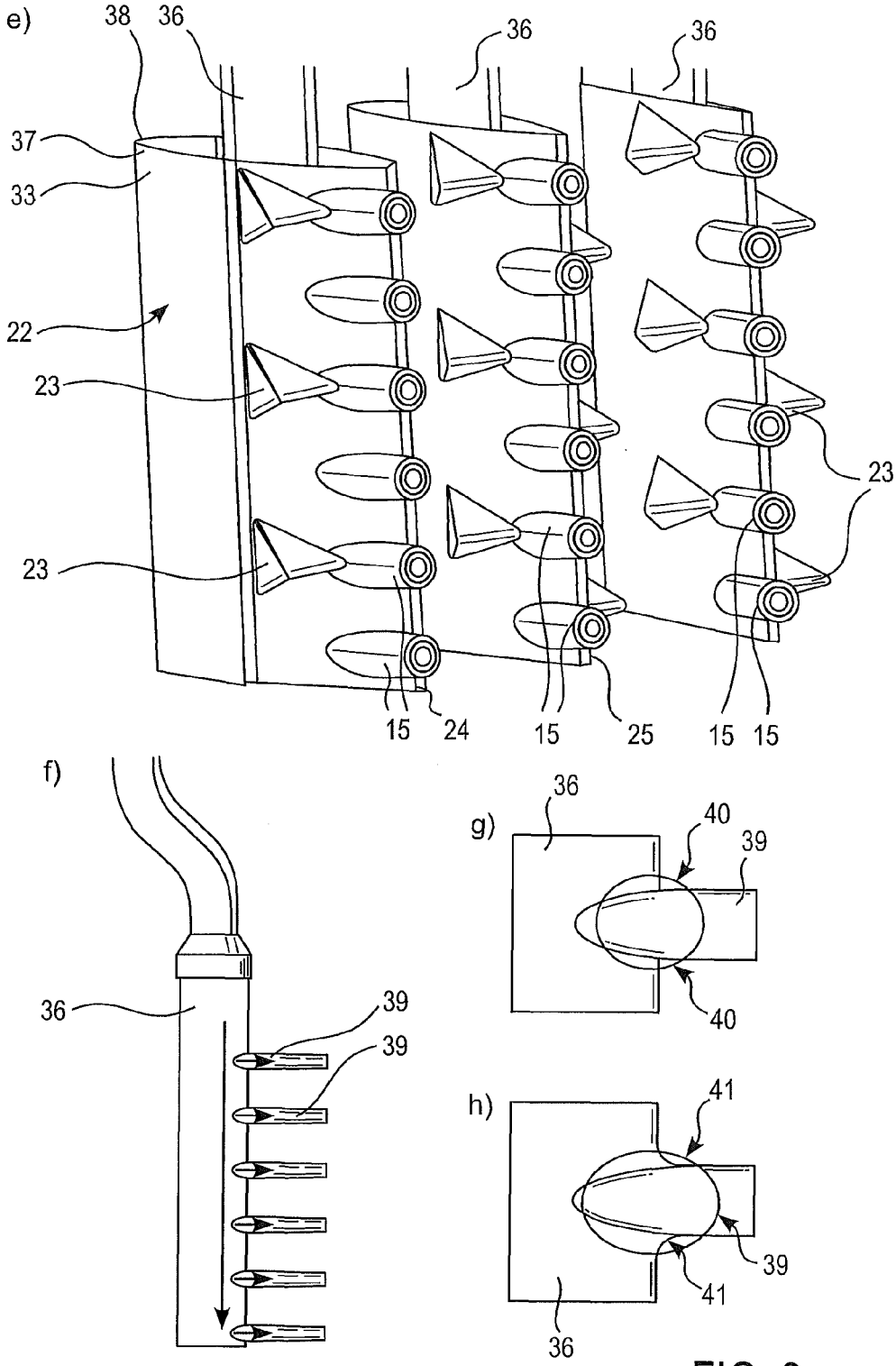

A burner, such as for high reactivity conditions, is disclosed (e.g., for a situation where the inlet temperature of the secondary burner is higher than reference, and/or for a situation where high reactivity fuels, specifically MBtu fuels, shall be burned in such a secondary burner).

An exemplary burner for a gas turbine, such as for a secondary combustion chamber of a gas turbine with sequential combustion, can include a first and a second combustion chamber, with an injection device for the introduction of at least one gaseous and/or liquid fuel into the burner. The burner may be provided for gaseous fuel only, for a liquid fuel only. It may however also be a dual burner, adapted for the combustion of gaseous fuel as well as liquid fuel.

The injection device can have at least one body which is arranged in the burner with at least one nozzle for introducing the at least one gaseous and/or liquid fuel into the burner, the at least one body being configured as a streamlined body which has a streamlined cross-sectional profile and which extends with a longitudinal direction perpendicularly or at an inclination to a main flow direction prevailing in the burner.

The body can have two opposite walls defining the flow space of the combustion airflow.

The body can have two lateral surfaces essentially parallel to the main flow direction, and in accordance with an exemplary embodiment, the at least one nozzle has its outlet orifice not at the trailing edge but downstream of a trailing edge of the streamlined body. In other words the fuel is injected into the combustion air stream at a position downstream of the trailing edge, behind the trailing edge or offset from the trailing edge in the flow direction. This offset or distance d between the trailing edge at the position of the nozzle, and the outlet orifice of said nozzle, measured along the main flow direction can, for example, be at least 2 mm (e.g., at least 3 mm, or in the range of 4-10 mm).

The provision of the point of injection of the fuel not at the trailing edge but downstream thereof, optionally in combination with in-line injection (as opposed to cross flow injection), allows a reduction of the pressure loss of the fuel injection. This in turn allows the injection of the fuel from the nozzle together with a low pressure carrier gas stream. Exemplary embodiments can work with a carrier air with a pressure in an exemplary range of 10-20 bar, such as in the range of, for example, 16-20 bar.

According to an exemplary embodiment, the body comprises an outer wall, closed circumferentially and defining said streamlined cross-sectional profile, wherein within this outer wall, there is provided a longitudinal inner fuel tubing element for the introduction of liquid and/or gaseous fuel, with branching off tubing, essentially extending parallel to the direction of the main flow direction, leading to the at least one nozzle for the delivery of fuel. The longitudinal inner fuel tubing is, for example, distanced from the outer wall defining an interspace for the delivery of carrier air to the at least one nozzle. The inner fuel tubing is circumferentially distanced from the outer wall such that the interspace is essentially circumferentially coherent. Correspondingly there is a carrier air flow surrounding the fuel delivery means which leads to a combined function of this interspace: on the one hand it has a cooling function the carrier air acting as a cooling gas, and on the other hand it provides the delivery of carrier air to the fuel nozzles. The outer wall may be provided with effusion/film cooling holes, in case of a double wall outer wall structure, it may also be provided with cooling holes in the inner wall element of the double wall outer wall structure leading to impingement cooling of the outer wall element of the double wall outer wall structure.

According to a further exemplary embodiment, the transitions between the longitudinal inner fuel tubing and the branching off tubing, on the fuel side thereof, can be provided with rounded edges. The provision of rounded edges, if gaseous fuel flows along the inner walls of the inner fuel tubing, can lead to a further enhancement of the flow properties and to further reduced pressure. Correspondingly this setup allows for even further reduced pressure loss and therefore, for example, permits the use of lower pressure carrier air.

The streamlined body can have a cross-sectional profile which is mirror symmetric with respect to the central plane of the body. For example, it can have an airwing-like structure with a rounded leading edge and a sharp trailing edge.

At least one nozzle, (e.g., at least two nozzles, for example, between 4 and 10 nozzles) can inject fuel and carrier gas essentially parallel to the main flow direction.

It is also possible that at least one nozzle (or several as given below) injects fuel and/or carrier gas at an inclination angle between, for example, 0-30° with respect to the main flow direction. Also inclination angles up to 60°, or greater, are possible.

The burner may also be a dual burner. In this case, within the longitudinal inner fuel tubing there is provided a second inner fuel tubing for a second type of fuel (this second type of fuel can, for example, be a liquid fuel), and gaseous fuel can be delivered via the interspace between the walls of said longitudinal inner fuel tubing and the walls of the second inner fuel tubing.

According to a further exemplary embodiment, upstream of the at least one nozzle on at least one lateral surface there is located at least one large-scale mixing device (vortex generator).

Exemplary embodiments can merge the vortex generator and the known use of a fuel injection device as separate elements into one single combined vortex generation and fuel injection device. By doing this, mixing of fuels with oxidation air and vortex generation take place in very close spatial vicinity and very efficiently, such that more rapid mixing is possible and the length of the mixing zone can be reduced while maintaining the main flow velocity. It is even possible in some cases, by corresponding design and orientation of the body in the oxidizing air path, to omit the flow conditioning elements (turbine outlet guide vanes) as the body may also take over the flow conditioning. All this is possible without severe pressure drop along the injection device such that the overall efficiency of the process can be maintained. Upstream of the body and downstream of the last row of rotating blades of the high-pressure turbine there can, for example, be no additional vortex generators, and no additional flow conditioning elements.

Such a vortex generator can have an attack angle in the exemplary range of 15-20° and/or a sweep angle in the exemplary range of 55-65°.

Generally speaking, vortex generators as they are disclosed in U.S. Pat. No. 5,803,602 as well as in U.S. Pat. No. 5,423,608 can be used in the present context, the disclosure of these two documents being specifically incorporated into this disclosure.

At least two nozzles can be arranged at different positions along said trailing edge, wherein upstream of each of these nozzles at least one vortex generator is located.

Vortex generators to adjacent nozzles can be located at opposite lateral surfaces, and, for example, more than three (e.g., at least four), nozzles can be arranged along said trailing edge and vortex generators are alternatingly located at the two lateral surfaces.

Downstream of each vortex generator there can be located at least two nozzles.

Such a vortex generator can further be provided with cooling elements, which can be are fed by carrier air as cooling medium via the interspace between the inner fuel tubing and the wall defining the cross-sectional profile of the body. These cooling elements can be film cooling holes provided in at least one of the surfaces of the vortex generator.

The streamlined body, as mentioned above, can extend across the entire flow cross section between opposite walls of the burner, wherein the burner can be a burner annularly arranged circumferentially with respect to a turbine axis. For example, in this case between 10-100 streamlined bodies, such as between 40-80 streamlined bodies, are arranged around the circumference, such as all of them being, for example, equally distributed along the circumference.

The profile of the streamlined body can be inclined with respect to the main flow direction at least over a certain part of its longitudinal extension wherein the profile of the streamlined body can be rotated or twisted in opposing directions relative to the longitudinal axis on both sides of a longitudinal midpoint.

Furthermore the present disclosure relates to the use of a burner as defined above for the combustion under high reactivity conditions, such as for the combustion at high burner inlet temperatures and/or for the combustion of MBtu fuel with a calorific value of 5000-20,000 kJ/kg (e.g., 7000-17,000 kJ/kg, preferably 10,000-15,000 kJ/kg, most preferably such a fuel comprising hydrogen gas).

Several exemplary design modifications to the existing secondary burner (SEV) designs are proposed herein to introduce a low pressure drop complemented by rapid mixing for highly reactive fuels and operating conditions. Exemplary embodiments target a low-pressure drop fuel lance system for a reheat flute lance and burner. The (50% or higher) reduced fuel pressure drop in the flute lance is due to less design complexity and the elimination of high momentum flux fuel jets for the state of the art cross flow lance configurations. The reduction in fuel pressure drop is evidenced in CFD and from successful operation of the flute lances in high pressure tests. Herein, inline fuel injection is proposed which eliminates the need for high-pressure (carrier air and fuel) specifications. An injection system with lower fuel pressure drop increases the likelihood of avoiding the use of fuel compression for the SEV. The low BTU and H2 fuels can require that fuel pressure drops inside the passage have to be acceptable.

Exemplary advantages of disclosed embodiments can be summarized as follows:

- Low fuel momentum flux of the fuel jets in the reheat lances can the fuel pressure requirement.
- The lower fuel pressure drop in the lance offers the possibility for fuel staging to control emissions and pulsations.
- Lower fuel pressure drop in the inline injectors allow for injecting H2 or Syngas with a reasonable pressure.

Flute design offers uniform fuel distribution across the injectors.

Known solutions:

- The cross flow fuel jet lances underlying principle of the current SEV technology incur very high-pressure drop due to complex flow features and high momentum flux of the fuel jet. The supply fuel pressure for the SEV is drawn from the EV gas compressors, which is high in order to obtain a high momentum flux ratio (e.g., around 8). The fuel gas pressure specifications for the reheat fuel lances should however be decreased in order to minimize the hardware costs and auxiliary power consumption by modifying the gas compressors for future engines.

With respect to performing a reasonable fuel air mixing, the following components of current burner systems are of interest:

- At the entrance of the SEV combustor, the main flow should be conditioned in order to guarantee uniform inflow conditions independent of the upstream disturbances (e.g. caused by the high-pressure turbine stage).

Then, the flow must pass four vortex generators.

For the injection of gaseous and liquid fuels into the vortices, fuel lances are used, which extend into the mixing section of the burner and inject the fuel(s) into the vortices of the air flowing around the fuel lance.

To this end FIG. 1 shows a known secondary burner 1. The burner, which is an annular combustion chamber, is bordered by opposite walls 3. These opposite walls 3 define the flow space for the flow 14 of oxidizing medium. This flow enters as a main flow 8 from the high pressure turbine (e.g., behind the last row of rotating blades of the high pressure turbine which is located downstream of the first combustor). This main flow 8 enters the burner at the inlet side 6. First this main flow 8 passes flow conditioning elements 9, which are typically turbine outlet guide vanes which are stationary and bring the flow into the proper orientation. Downstream of these flow conditioning elements 9 vortex generators 10 are located in order to prepare for the subsequent mixing step. Downstream of the vortex generators 10 there is provided an injection device or fuel lance 7 which can include a foot 16 and an axial shaft 17. At the most downstream portion of the shaft 17 fuel injection takes place, in this case fuel injection takes place via orifices/nozzles which inject the fuel in a direction perpendicular to flow direction 14 (cross flow injection).

Downstream of the fuel lance 7 there is the mixing zone 2, in which the air, bordered by the two walls 3, mixes with the fuel and then at the outlet side 5 exits into the combustion space 4 where self-ignition takes place.

At the transition between the mixing zone 2 to the combustion space 4 there can be a transition 13, which may be in the form of a step, or as indicated here, may be provided with round edges and also with stall elements for the flow. The combustion space is bordered by the combustion chamber wall 12.

This leads to a fuel mass fraction contour 11 at the burner exit 5 as indicated on the right side of FIG. 1.

The fuel lance is equipped with a carrier air passage, which is desired for the following exemplary reasons:

- The carrier air is slowing down the reactivity of the fuel air mixture by local effects on both, temperature and equivalence ratio.
- The carrier air is also used for cooling the lance.
- SEV-burners are currently designed for operation on natural gas and oil. The carrier air increases the momentum flux of the fuel in order to penetrate the vortices and allow a good fuel air mixing behavior.

The system needs carrier air, normally taken from the last compressor stage of the gas turbine with the following drawbacks arising:

- The air is bypassing the high pressure turbine thus resulting in efficiency losses
- Another drawback is related to the complicated design of the current SEV system.

With low enough fuel pressure requirements, as made possible according to the exemplary embodiments disclosed herein, an SEV burner can be fed without fuel compression (e.g., it is possible to feed the SEV with network pressure only (e.g., in the range of 10-20 bar, as compared to high-pressure which can be in the range of 25-35 bar).

FIG. 2 shows two possible fuel lances 7 which can be located in the cavity of the burner upstream of the mixing space 2. In FIG. 2*a* a so called dual fuel lance is illustrated, so a fuel lance which can be operated with liquid fuel as well as with gaseous fuel. The fuel lance element as illustrated in a central cut comprises, as concerns the part protruding into the flow space of the combustion air, a foot portion 16 which is arranged longitudinally, and a shaft 17 which extends along the flow direction 14 of the oxidizing medium. There is provided a flange portion to be forming part of the burner wall 3, in this portion a thermocouple 21 may be located for controlling purposes. A second flange is provided to incorporate this lance system in an outer wall 19.

This lance is provided with an outermost wall, followed by a separation wall defining an interspace 31 for the delivery of the carrier gas on the outer side and on the inner side defining an interspace for the fuel gas feed.

Within this cavity of the fuel gas feed 30 there is provided a further tube 20, the interior of which provides the liquid fuel feed 18.

In the tip portion of the lance 7 there are provided several fuel nozzles 15 arranged circumferentially and injecting fuel mixed with carrier gas or enclosed by carrier gas in a cross flow direction as illustrated with arrow 34.

The pressure drops in such a system as concerns the fuel gas supply as well as the carrier gas are substantial due to the geometrical conditions as well as due to the fact that the fuel needs to be injected in a cross flow direction in order to provide for a sufficient and complete mixing of fuel with oxidizing air prior to ignition.

In FIG. 2*b* a gas only lance is given. Essentially this design is identical to the one as illustrated in FIG. 2*a*, however the tubing 20 for the liquid fuel supply is omitted. Also in this design the pressure drop of the fuel gas and of the carrier gas can be significant.

The pressure drops in the designs according to FIG. 2 can be high and in the order of at least 8-9 bar near the fuel exit regions, these pressure drops being used to produce very high fuel velocities (300-400 m/sec) and momentum fluxes to shoot the jets in a cross flow manner into the surrounding vortices.

Figure 4:
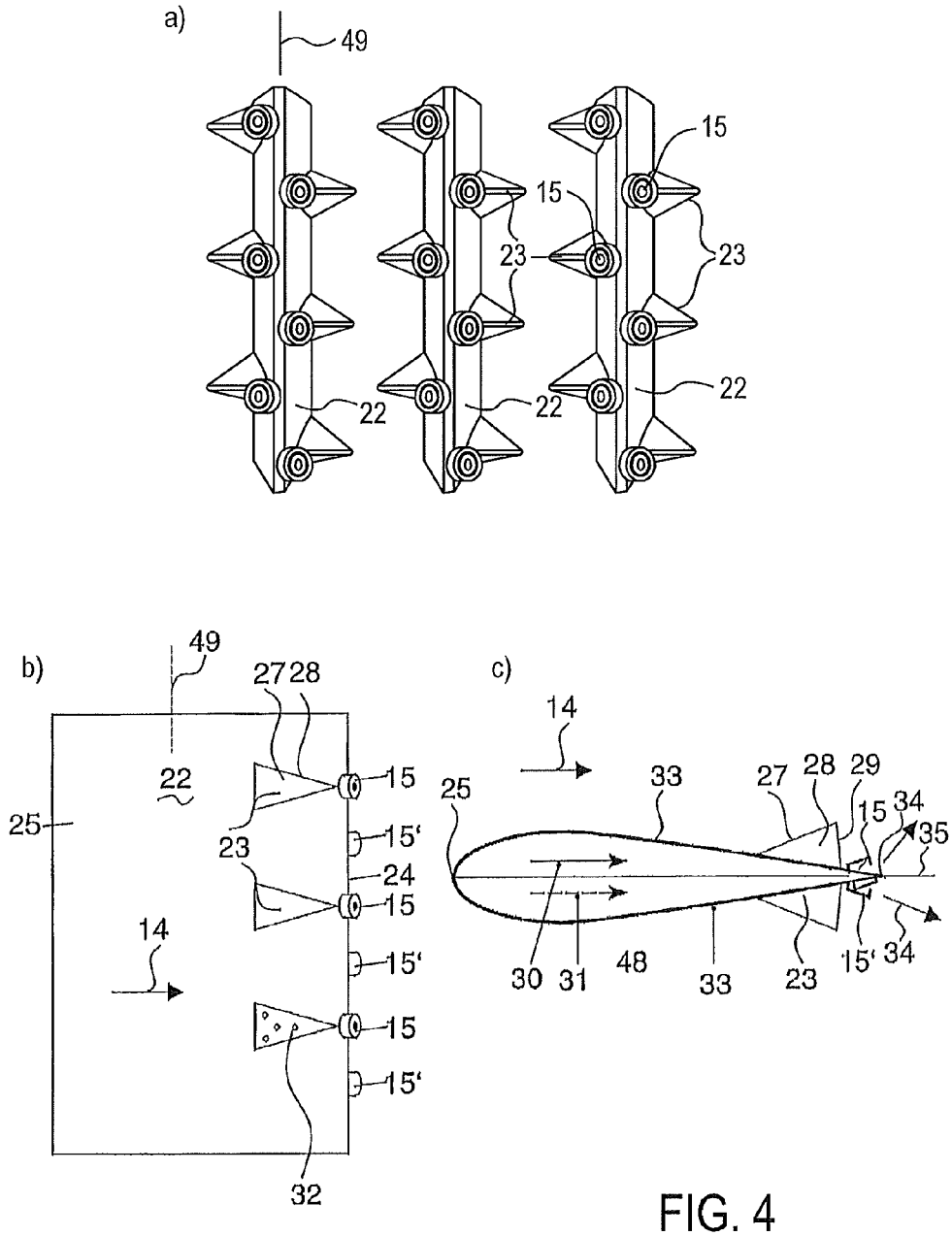
FIG. 4 shows exemplary embodiments in a) the streamlined body in a view opposite to the direction of the flow of oxidising medium with fuel injection inclined to the flow of oxidising medium, in b) a side view onto such a streamlined body, in c) a cut perpendicular to the central plane of the streamlined body.

The newly proposed solution can include inline fuel injection using flute design as illustrated in FIGS. 3 and 4, where the fuel momentum flux is of same order of hot gas and carrier air momentum fluxes. Due to the very low momentum flux requirement, the fuel and carrier air upstream pressures can be reduced to much lower levels (see FIG. 5) compared to the state of the art designs. The high pressure test showed the possibility of using lower upstream fuel pressure without any adverse issues with thermo acoustics etc.

The pressure drop occurs only near the fuel exit region, which can be essential to provide desired fuel velocities and momentum. In a majority of the fuel passage region the pressure drop is very low. This design offers the potential to use lower SEV upstream pressures of the fuel. Overall fuel pressure drop inside the SEV flute lance is of the order of 2-3 bars, which is much lower than the known configurations (8-10 bar). There is further improvement possible by providing increased effective flow areas.

More specific embodiments of the inline injection with flute/VG concept shall be presented below.

Embodiment 1

The first exemplary embodiment to this concept is to have in-line injection (the fuel injection direction 34 is essentially parallel to the main flow direction 14) and to combine this type of fuel injection with vortex generators upstream of the nozzles of fuel injection. The distance d between the trailing edge 24 and the actual exit orifice of the nozzle is in the range of, for example, 5 mm. The vortex generators 23 embedded on the flutes 22 are staggered as shown in FIG. 3. The vortex generators 23 are located sufficiently upstream of the fuel injection location to avoid flow recirculations. The vortex generator attack and sweep angles are chosen to produce highest circulation rates at a minimum pressure drop.

Such vortex generators have an attack angle $\alpha$ in the range of 15-20° and/or a sweep angle $\beta$ in an exemplary range of 55-65°, for a definition of these angles reference is made to FIG. 3*i*), where for an orientation of the vortex generator in the air flow 14 as given in FIG. 3 *a*) the definition of the attack angle $\alpha$ is given in the upper representation which is an elevation view, and the definition of the sweep angle $\beta$ is given in the lower representation, which is a top view onto the vortex generator.

As illustrated the body 22 is defined by two lateral surfaces 33 joined in a smooth round transition at the leading edge 25 and ending at a sharp angle at the trailing edge 24. Upstream of trailing edge the vortex generators 23 are located. The vortex generators are of triangular shape with a triangular lateral surface 27 converging with the lateral surface 33 upstream of the vortex generator, and two side surfaces 28 essentially perpendicular to a central plane 35 of the body 22. The two side's surfaces 28 converge at a trailing edge 29 of the vortex generator 23, and this trailing edge is just upstream of the corresponding nozzle 15.

The lateral surfaces 27, but also the side surfaces 28, may be provided with effusion cooling holes 32.

The whole body 22 is arranged between and bridging two opposite two walls 3 of the combustor, so along a longitudinal axis 49 essentially perpendicular to the walls 3. Parallel to this longitudinal axis there is, according to this embodiment, the leading edge 25 and the trailing edge 24. It is however also possible that the leading edge 25 and/or the trailing edge are not linear but are rounded.

At the trailing edge the nozzles 15 for fuel injection are located. In this case fuel injection takes place along the injection direction 35 which is parallel to the central plane 35 of the body 22. Fuel as well as carrier air are transported to the nozzles 15 as schematically illustrated by arrows 30 and 31, respectively. For example, the fuel supply is provided by a central tubing, while the carrier air is provided in a flow adjacent to the walls 33 to also provide internal cooling of the structures 22. The carrier airflow is also used for supply of the cooling holes 23. Fuel is injected by generating a central fuel jet along direction 34 enclosed circumferentially by a sleeve of carrier air.

The staggering of vortex generators 23 helps in avoiding merging of vortices resulting in preserving very high net longitudinal vortices. The local conditioning of fuel air mixture with vortex generators close to respective fuel jets improves the mixing. The overall burner pressure drop is significantly lower for this concept. The respective vortex generators produce counter rotating vortices which at a specified location pick up the axially spreading fuel jet.

FIG. 3*e* shows a perspective view of such a set up wherein the wall bordering the combustion cavity has been omitted. There is an inner fuel tubing 36 which extends longitudinally into the cavity defined by the outer wall 36 of the body 22. This tubular or hollow wing like element 36, normally shaped similarly but smaller than the outline of the wall 37, is located in this cavity such that its wall is circumferentially distanced from the outer wall 37 thus forming a circumferential interspace 38 extending along longitudinal direction. It is through this interspace 38 that the carrier air is delivered through the streamlined body 22 and to the nozzles 15.

The carrier air thus is not only delivered to the nozzles but also shields in a cooling manner the longitudinal part 36 of the inner fuel tubing and it also cools the outer wall 37 at the same time. The cooling is not only a convective cooling but can also be impingement cooling (e.g., by providing an inner channel for the carrier air with holes such that carrier air penetrates through the holes and impinges onto the outer wall of the body 22).

FIG. 3*f* illustrates just the supply part for the fuel in such a setup. The longitudinal inner fuel tubing part 36 has branching off tubing 39 branching off at the trailing edge thereof passing through the interspace 38 to the axial nozzles 15 and allowing the fuel to be delivered to the orifices of the nozzles 15. These branching off tubings can therefore be essentially parallel to the main flow direction 14 and also these branching off tubings are cooled by the carrier air stream surrounding them.

Within this supply structure there may be provided a second tubing, such as for the supply of liquid fuel located in a manner such that in the interspace between this second supply tubing and the outer wall of the element 36 as illustrated the gaseous fuel can flow and be supplied to the nozzles.

The pressure drop of the gas supplied as fuel to the nozzle depends on the flow conditions within the flow cavity of the gaseous fuel. In the situation as illustrated in FIG. 3*g* the transition region 40 between the longitudinal part 36 and the branching of part 39 is a sharp edge 40.

The pressure drop across the fuel supply can be further reduced by providing, as illustrated in FIG. 3*h*, a more smooth transition region 48 so if not only at the outside as illustrated but also on the inside the transitions between the longitudinal part 36 and the branching of tube 39 are rounded to avoid vortexes in the fuel gas supply part leading to high pressure drops.

In somewhat more detail three bodies 22 arranged within an annular secondary combustion chamber are given in perspective view in FIG. 3 *k*, wherein the bodies are cut perpendicularly to the longitudinal axis 49 to show their interior structure.

In the cavity formed by the outer wall 37 of each body on the trailing side thereof there is located the longitudinal inner fuel tubing 36. It is distanced from the outer wall 37, wherein this distance is maintained by distance keeping elements 53 provided on the inner surface of the outer wall 37.

From this inner fuel tubing 36 the branching off tubing extends towards the trailing edge 29 of the body 22. The outer walls 37 at the position of these branching off tubings is shaped such as to receive and enclose these branching off tubings forming the actual fuel nozzles with orifices located downstream of the trailing edge 29.

In the essentially cylindrically shaped interior of the branching off tubings there is located a cylindrical central element 50 which leads to an annular stream of fuel gas. As between the wall of the branching off tubings and the outer walls 37 at this position there is also an essentially annular interspace, this annular stream of fuel gas at the exit of the nozzle is enclosed by an essentially annular carrier gas stream.

Towards the leading edge of the body 22 in the cavity formed by the outer wall 37 of the body in this embodiment there is located a carrier air tubing channel 51 extending essentially parallel to the longitudinal inner fuel tubing channel 36. Between the two channels 36 and 51 there is an interspace 55. The walls of the carrier air tubing channel 51 facing the outer walls 37 of the body 22 run essentially parallel thereto again distanced therefrom by distancing elements 53. In the walls of the carrier air tubing channel 51 there are located cooling holes 56 through which carrier air travelling through channel 51 can penetrate. Air penetrating through these holes 56 impinges onto the inner side of the walls 37 leading to impingement cooling in addition to the convective cooling of the outer walls 37 in this region.

Within the walls 37 there are provided the vortex generators 23 in a manner such that within the vortex generators cavities 54 are formed which are fluidly connected to the carrier air feed. From this cavity the effusion/film cooling holes 32 are branching off for the cooling of the vortex generators 23. Depending on the exit point of these holes 32 they are inclined with respect to the plane of the surface at the point of exit in order to allow efficient film cooling effects.

Embodiment 2

Another embodiment of this concept as shown in FIG. 4, is to direct the fuel at a certain angle (can be increased up to, for example, 90°). The second embodiment to this concept is to have not cross flow injection but inclined injection (the fuel injection direction 34 is at an exemplary angle of approximately 15-30° to the main flow direction 14) and to combine this type of fuel injection with vortex generators upstream of the nozzles of fuel injection. The distance between the trailing edge 24 and the actual exit orifice of the nozzle is again in the range of, for example, 5 mm. In this case, the fuel is directed into the vortices and this has shown to improve mixing even further.

More specifically in this case there are, along the row of nozzles 15, a first set of three nozzles 15, which are directing the fuel jet 34 out of plane 35 at one side of plane 35, and the second set of nozzles 15' directing the corresponding fuel jet out of plane at the other side of plane 35. The more the fuel jets 34 are directed into the vortices the more efficient the mixing takes place.

Figure 5:
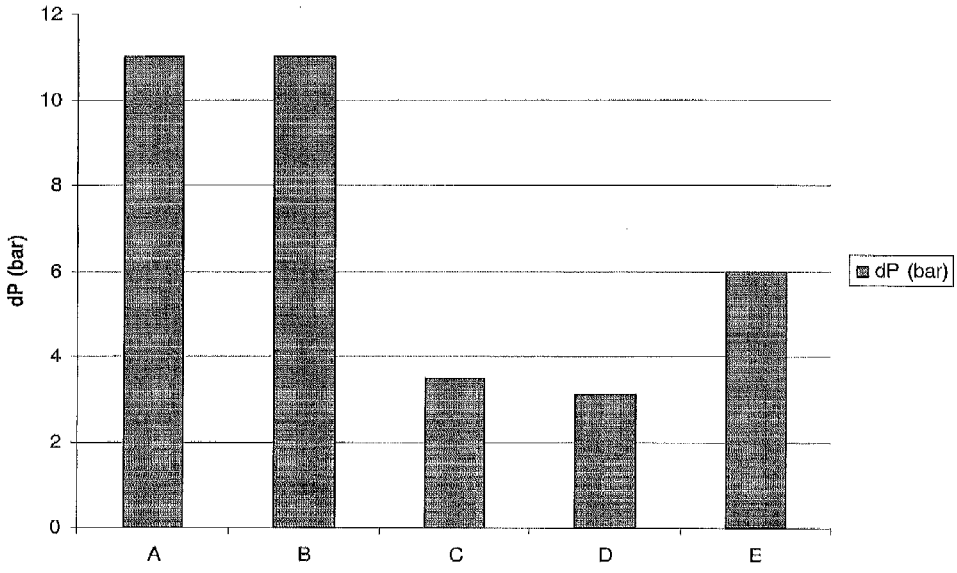
FIG. 5 shows an exemplary comparison of cross flow and inline injection fuel lances.

FIG. 5 shows a comparison of cross flow and inline injection fuel lances. The bars A and B show the pressure drop for the fuel lances according to FIGS. 2 *a*) and *b*) respectively. A pressure drop of more than 10 bar is experienced in these exemplary systems necessitating high-pressure fuel and high-pressure carrier air supply. Bar C illustrates the pressure drop for the configuration according to FIG. 3 *g*), in this case the pressure drop is, for example, reduced to just above 3 bar. The pressure drops for the flute lances for example with fuel injection downstream of the trailing edge are much smaller when compared to the state of the art cross flow fuel jet configurations. The pressure drop can be further reduced if the configuration according to FIG. 3 *h*) with more smooth flow conditions for the gaseous fuel is used, the situation being illustrated with the bar D giving a pressure drop of just about 3 bar. As outlined in the general introduction, the proposed concept can also be used for dual fuel injection. The pressure drop in this situation, where natural gas supply as well as liquid fuel supply (provided in the inside of the natural gas supply channel) is illustrated with bar E in FIG. 5. Also here the pressure drop, while being somewhat higher than in case of natural gas supply only, is still almost a factor of two lower than for fuel lances as illustrated in FIG. 2.

The lower fuel pressure drop can be increased to improve performance characteristics such as emissions, pulsations achievable with fuel staging in the lance. Also fuel staging in the flute lance is possible.

Exemplary advantages of the flute fuel injection system:

- Low momentum flux of the inline fuel jets allows for low fuel pressure drop in the reheat lance.
- Inline injection design ensures uniform fuel flow for all the jets as compared to pressure drop required for the lances (according to FIG. 2) to attain flow uniformity at the fuel exit.
- The low fuel pressure drop obtained from flute design can be utilized for injecting syngas or H2 fuels where excess flow rates are desired.
- The low fuel pressure drop in the flute injection system allows for utilizing an additional fuel compressor for the reheat combustor. This avoids the need to using high pressure fuel from the EV compressor.
- The lower fuel pressure drop in the lance offers fuel staging to control emissions and pulsations.

The low fuel pressure requirement can avoid the use of a compressor for SEV fuel injection.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 burner
2 mixing space, mixing zone
3 burner wall
4 combustion space
5 outlet side, burner exit
6 inlet side
7 injection device, fuel lance
8 main flow from high-pressure turbine
9 flow conditioning, turbine outlet guide vanes
10 vortex generators
11 fuel mass fraction contour at burner exit 5
12 combustion chamber wall
13 transition between 3 and 12
14 flow of oxidising medium
15 fuel nozzle
16 foot of 7
17 shaft of 7
16 foot of 7
17 shaft of 7
18 liquid fuel feed
19 outer wall
20 tube forming 18
21 thermocouple
22 streamlined body
23 vortex generator on 22
24 trailing edge of 22
25 leading edge of 22
26 injection direction
27 lateral surface of 23
28 side surface of 23
29 trailing edge of 23
30 fuel gas feed
31 carrier gas feed
32 film cooling holes
33 lateral surface of 22
34 ejection direction of fuel/carrier gas mixture
35 central plane of 22
36 inner fuel tubing, longitudinal part
37 outer wall of 22
38 interspace between 36 and 37
39 branching off tubing of inner fuel tubing
40 transition region between 36 and 39, sharp edge
41 transition region between 36 and 39, rounded edge
48 cross-sectional profile of 22
49 longitudinal axis of 22
50 central element
51 carrier air channel
52 interspace between 37 and 51
53 distance keeping elements
54 cavity within 23
55 interspace between 51 and 36
56 cooling holes

What is claimed is:

1. Burner for a combustor of a turbine, comprising:

an injection device for introduction of at least one gaseous and/or liquid fuel into the burner, wherein the injection device has at least one body which is arranged in the burner with at least two nozzles at a trailing edge of the body for introducing the at least one fuel into the burner, the at least one body being configured as a streamlined body which has a streamlined cross-sectional profile and which extends with a longitudinal direction perpendicularly or at an inclination to a main flow direction prevailing in the burner, the at least one body including tubing for supplying the at least one gaseous and/or liquid fuel to the at least two nozzles and an interspace for delivery of carrier air to the at least two nozzles; and two lateral surfaces of the body essentially parallel to the main flow direction, wherein the at least two nozzles have outlet orifices downstream of the trailing edge of the streamlined body for injecting the fuel and the carrier gas at an inclination angle of between 0-30° with respect to the main flow direction.

2. Burner according to claim 1, wherein the distance (d) between the essentially straight trailing edge at the position of the nozzles, and the outlet orifices of said nozzles, measured along the main flow direction, is at least 2 mm.

3. Burner according to claim 1, wherein the body comprises:

an enclosing outer wall defining said streamlined cross-sectional profile, wherein within this outer wall, there is provided a longitudinal inner fuel tubing for introduction of liquid and/or gaseous fuel, with branching off tubing leading to the at least two nozzles.

4. Burner according to claim 3, wherein the longitudinal inner fuel tubing is circumferentially distanced from the outer wall defining the interspace for delivery of carrier air to the at least two nozzles.

5. Burner according to claim 3, wherein transitions between the longitudinal inner fuel tubing and the branching off tubing, on the fuel side thereof, are provided with rounded edges.

6. Burner as claimed in claim 1, wherein the streamlined body has a cross-sectional profile which is mirror symmetric with respect to a central plane of a body.

7. Burner according to claim 3, wherein within said longitudinal inner fuel tubing there is provided a second inner fuel tubing for a second type of fuel, wherein this second type of fuel is a liquid fuel and wherein gaseous fuel is delivered by an interspace between walls of said longitudinal inner fuel tubing and walls of the second inner fuel tubing.

8. Burner as claimed in claim 1, wherein upstream of the at least two nozzles on at least one of the at least two lateral surfaces there is located at least one vortex generator, wherein the vortex generator has an attack angle in a range of 15-20° and/or a sweep angle in a range of 55-65°, wherein the at least two nozzles are arranged at different positions along said trailing edge, wherein upstream of each of these at least two nozzles at least one vortex generator is located, and wherein vortex generators to adjacent nozzles are located at opposite lateral surfaces.

9. Burner according to claim 8, wherein the at least one vortex generator is provided with cooling elements, wherein these cooling elements are effusion cooling holes provided in at least one surface of the vortex generator, and wherein the cooling holes are fed with air from the carrier gas feed used for fuel injection.

10. Burner according to claim 1, wherein the streamlined body extends across an entire flow cross section between opposite walls of the burner, wherein the burner is an annular burner arranged circumferentially with respect to a turbine axis, and wherein between 10-100 streamlined bodies, are arranged around the circumference, all of them being equally distributed along the circumference.

11. Burner according to claim 1, wherein the body is provided with cooling elements, wherein these cooling elements are for internal circulation of cooling medium along sidewalls of the body and/or cooling holes located near the trailing edge, and wherein the cooling elements are fed with air from the carrier gas feed also used for fuel injection.

12. Burner according to claim 1, wherein upstream of the body and downstream of a last row of rotating blades of the turbine there are no additional vortex generators, and no additional flow conditioning elements arranged inside the walls of the burner.

13. Burner according to claim 1, wherein the nozzles are configured to inject fuel together with a carrier air stream, and wherein the carrier air is low pressure air with a pressure in a range of 10-20 bar.

14. A burner according to claim 1, in combination with a combustion chamber for the combustion of MBtu fuel with a calorific value of 5000-20,000 kJ/kg.

15. Burner according to claim 1, wherein the distance (d) between the essentially straight trailing edge at the position of the nozzles, and the outlet orifices of said nozzles, measured along the main flow direction, is at least 3 mm.

16. Burner according to claim 1, wherein the distance (d) between the essentially straight trailing edge at the position of the nozzles, and the outlet orifices of said nozzles, measured along the main flow direction, is at least 4-10 mm.

17. Burner according to claim 8, wherein at least four nozzles are arranged along said trailing edge and vortex generators alternatingly are located at the two lateral surfaces, or wherein downstream of each vortex generator there are located the at least two nozzles.

18. Burner according to claim 1, wherein the streamlined body extends across an entire flow cross section between opposite walls of the burner, wherein the burner is an annular burner arranged circumferentially with respect to a turbine axis, and wherein between 40-80 streamlined bodies, are arranged around the circumference, all of them being equally distributed along the circumference.

19. Burner according to claim 1, wherein the nozzles are configured to inject fuel together with a carrier air stream, and wherein the carrier air is low pressure air with a pressure in a range of 16-20 bar.

20. A burner according to claim 1, in combination with a combustion chamber for the combustion of MBtu fuel with a fuel comprising hydrogen gas.

* * * * *